US005871877A

United States Patent [19]

Ong et al.

[11] Patent Number: 5,871,877

[45] Date of Patent: Feb. 16, 1999

[54] PHOTOCONDUCTIVE IMAGING MEMBERS

[75] Inventors: Beng S. Ong; Ping Liu; Cheng-Kuo Hsiao, all of Mississauga, Canada

[73] Assignee: Xerox Corporation, Stamford, Conn.

[21] Appl. No.: 124,717

[22] Filed: Jul. 30, 1998

[51] Int. Cl.[6] ..... G03G 5/047; G03G 5/14

[52] U.S. Cl. ..... 430/59; 430/58; 430/64

[58] Field of Search ..... 430/58, 59, 64

[56] References Cited

U.S. PATENT DOCUMENTS

| | | | |
|---|---|---|---|
| 4,265,990 | 5/1981 | Stolka et al. | 430/59 |
| 4,298,697 | 11/1981 | Baczek et al. | 521/27 |
| 4,338,390 | 7/1982 | Lu | 430/106 |
| 4,464,450 | 8/1984 | Teuscher | 430/59 |
| 4,555,463 | 11/1985 | Hor et al. | 430/59 |
| 4,560,635 | 12/1985 | Hoffend et al. | 430/106.6 |
| 4,587,189 | 5/1986 | Hor et al. | 430/59 |
| 4,921,769 | 5/1990 | Yuh et al. | 430/64 |
| 4,921,773 | 5/1990 | Melnyk et al. | 430/132 |
| 5,372,904 | 12/1994 | Yu et al. | 430/64 |
| 5,378,566 | 1/1995 | Yu | 430/64 |
| 5,460,911 | 10/1995 | Yu et al. | 460/64 |
| 5,473,064 | 12/1995 | Mayo et al. | 540/141 |
| 5,482,811 | 1/1996 | Keoshkerian et al. | 430/135 |
| 5,493,016 | 2/1996 | Burt et al. | 540/139 |
| 5,612,157 | 3/1997 | Yuh et al. | 430/58 |
| 5,645,965 | 7/1997 | Duff et al. | 430/59 |
| 5,660,961 | 8/1997 | Yu et al. | 430/58 |

*Primary Examiner*—Roland Martin
*Attorney, Agent, or Firm*—E. O. Palazzo

[57] ABSTRACT

A photoconductive imaging member comprised of a supporting substrate, a hole blocking layer thereover, a photogenerating layer and a charge transport layer, and wherein the hole blocking layer is comprised of a crosslinked polymer material schematically represented by structure (VII), and is derived from crosslinking a mixture of electron transport polymer (I) and organosilane (II).

34 Claims, No Drawings

PHOTOCONDUCTIVE IMAGING MEMBERS

COPENDING APPLICATIONS AND PATENTS

Disclosed in copending application U.S. Ser. No. 700,326, now U.S. Pat No. 5,645,965, the disclosure of which is totally incorporated herein by reference, are photoconductive imaging members with perylenes and a number of charge transports, such as amines.

Disclosed in copending application U.S. Ser. No. 09/124,789, filed concurrently herewith, the disclosure of which is totally incorporated herein by reference, are photoconductive imaging members, with a hole blocking layer comprised of a crosslinked polymer derived from crosslinking a alkoxysilyl-functionalized polymer bearing an electron transporting moiety. An advantage of the blocking layer of the present invention as compared to D/97448 may include shorter curing times and higher degrees of crosslinking which renders the blocking layer further resistant to attack by common organic coating solvent. A faster curing time could also render the fabrication of the blocking layer more compatible with web-coating processes utilized in the fabrication of belt photoreceptors.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Also, illustrated in U.S. Pat. No. 5,645,965, the disclosure of which is totally incorporated herein by reference, are symmetrical perylene photoconductive members.

BACKGROUND OF THE INVENTION

This invention is generally directed to imaging members, and, more specifically, the present invention is directed to improved multilayered imaging members with a solvent resistant hole blocking layer comprised of a crosslinked electron transport polymer derived from crosslinking a thermally crosslinkable alkoxysilyl, acyloxysilyl or halosilyl-functionalized electron transport polymer with an alkoxysily, acyloxysilyl or halosilyl compound such as alkyltrialkoxysilane, alkyltrihalosilane, alkylacyloxysilane, aminoalkyltrialkoxysilane, and the like, preferably in contact with the supporting substrate and situated between the supporting substrate and the photogenerating layer, and which layer may be comprised of the photogenerating pigments of U.S. Pat. No. 5,482,811, the disclosure of which is totally incorporated herein by reference, especially Type V hydroxygallium phthalocyanine. The imaging members of the present invention in embodiments exhibit excellent cyclic/environmental stability, independent layer discharge, and substantially no adverse changes in performance over extended time periods, provide imaging members with solvent resistant blocking layers, and enable suitable hole blocking layer thickness that can be easily coated on the supporting substrate by various coating techniques of for example dip or slot-coating. The aforementioned photoresponsive, or photoconductive imaging members can be negatively charged when the photogenerating layers are situated between the hole transport layer and the blocking layer deposited on the substrate. Processes of imaging, especially xerographic imaging and printing, including digital, are also encompassed by the present invention. More specifically, the layered photoconductive imaging members can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 550 to about 900 nanometers, and in particular, from about 650 to about 850 nanometers, thus diode lasers can be selected as the light source. Moreover, the imaging members of this invention are preferably useful in color xerographic applications where several color printings can be achieved in a single pass.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers.

Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport can be selected for the imaging members of the present invention.

In U.S. Pat. No. 4,921,769, the disclosure of which is totally incorporated herein by reference there is illustrated photoconductive imaging members with blocking layers of certain polyurethanes. In embodiments the present invention selects as the blocking layer a crosslinked polymer wherein the BCFM segments of the U.S. Pat. No. 4,921,769 patent are covalently attached to the polymer. Advantages of the hole blocking layer of the present invention over that of the '769 patent include excellent resistance to solvent degradation, superior electron transport, excellent synthetic accessibility preparation of the precursor polymer and ease of fabrication of the blocking layers.

SUMMARY OF THE INVENTION

It is a feature of the present invention to provide imaging members thereof with many of the advantages illustrated herein such as a more rapid curing hole blocking layer.

Another feature of the present invention relates to the provision of improved layered photoresponsive imaging members with photosensitivity to near infrared radiations.

It is yet another feature of the present invention to provide improved layered photoresponsive imaging members with a sensitivity to visible light, and which members possess improved coating characteristics and wherein the charge transport molecules do not diffuse, or there is minimum diffusion thereof into the photogenerating layer.

Moreover, another feature of the present invention relates to the provision of layered photoresponsive imaging members with durable, and solvent resistant hole blocking layers.

In a further feature of the present invention there are provided imaging members containing highly crosslinked blocking polymer layers and photogenerating pigments of Type V hydroxygallium phthalocyanine.

Aspects of the present invention relate to a photoconductive imaging member comprised of a supporting substrate, a hole blocking layer thereover, a photogenerating layer and a charge transport layer, and wherein the hole blocking layer is comprised of a crosslinked polymer of the formula

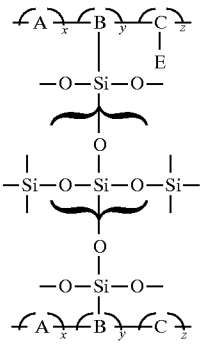

(VII)

wherein E is an electron transport moiety; A, B, and C represent the segments of the polymer backbone containing, for example, appropriate divalent linkages; and x, y, and z are mole fractions of the repeating monomer units wherein x+y+z is equal to about 1; a photoconductive imaging member wherein x is from about 0 to about 0.95, y is from about 0.01 to about 0.50, and z is from about 0.01 to about 0.50; a photoconductive imaging member wherein two divalent linkages of (I) are independently selected from the group consisting of arylene (—Ar—), alkylenearyl (—R'—Ar—), alkyleneoxycarbonyl (—R'—O—CO—), aryleneoxycarbonyl (—Ar—O—CO—), alkylenearyloxycarbonyl (—R'—Ar—O—CO—), arylenealkoxycarbonyl (—Ar—R'—O—CO—), and carbonyloxyalkyleneaminocarbonyl (—CO—O—R'—NR"—CO—), and wherein Ar contains from about 6 to about 24 carbon atoms, R' contains from about 1 to about 10 carbon atoms, and R" is hydrogen or alkyl; a photoconductive imaging member wherein organosilane (II) is selected from the group consisting of methyltrichlorosilane, dimethyidichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, and 3-aminopropyltriethoxysilane; a photoconductive imaging member wherein the hole blocking layer is prepared from crosslinking an organosilane (II) and an electron transport polymer (III)

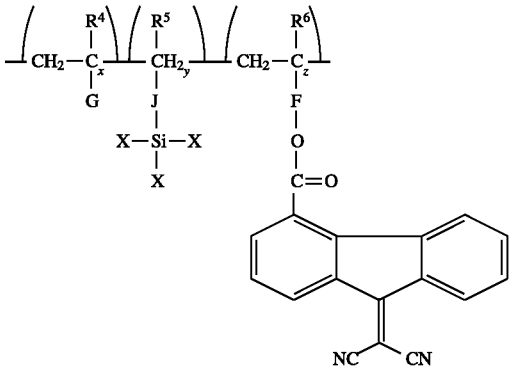

(III)

wherein $R^4$, $R^5$ and $R^6$ are hydrogen and alkyl; X is selected from the group consisting of halogen like chloride, bromide, or iodide, cyano, alkoxy of about 1 to about 10 carbon atoms, and acyloxy of about 2 to about 10 carbon atoms; J is selected from the group consisting of alkyleneoxycarbonyl of about 2 to about 10 carbon atoms, arylene of about 6 to about 15 carbon atoms, alkylenearyl of about 7 to about 15 carbon atoms, aryleneoxycarbonyl of about 7 to about 15 carbon atoms, and alkylenearyloxycarbonyl of about 8 to about 25 carbon atoms; F is arylene of about 6 to about 15 carbon atoms, arylenealkyl of about 7 to about 15 carbon atoms, carbonyloxyalkylene of about 2 to about 10 carbon atoms, and the like; G is halide, such as chloride, cyano, aryl of about 6 to about 15 carbon atoms, or alkoxycarbonyl of 2 to about 15 carbon atoms, or aryloxycarbonyl of 7 to about 15 carbon atoms, x, y and z are the mole fractions of the repeating units of the polymer, and wherein x ranges from about 0 to about 0.95, y ranges from about 0.01 to about 0.50, and z ranges from about 0.01 to about 0.50, and wherein the sum of x+y+z is equal to 1; a photoconductive imaging member wherein G is alkoxycarbonyl of from about 2 to about 10 carbon atoms, X is alkoxy of from about 1 to about 5 carbon atoms and F is alkylenearyl of from about 7 to about 15 carbon atoms; a photoconductive imaging member wherein G is methoxycarbonyl, X is an alkoxy like methoxy or ethoxy, and F is methylenephenyl; a photoconductive imaging member wherein the hole blocking layer is of a thickness of about 0.1 to about 5 microns; a photoconductive imaging member wherein the hole blocking layer is of a thickness of about 1 to about 5 microns; a photoconductive imaging member wherein polymer (III) is selected from the group consisting of polymers of the formulas (III-a) through (III-h) illustrated herein; a photoconductive imaging member wherein the organosilane (II) is selected from the group consisting of alkylhalosilanes, alkylalkoxysilanes, aminoalkylsilanes, and the like, such as methyltrichlorosilane, dimethyldichlorosilane, methyltrimethoxysilane, methyltriethoxysilane, ethyltrichlorosilane, ethyltrimethoxysilane, dimethyidimethoxysilane, methyltriethoxysilane, ethyltriethoxysilane, propyltrimethoxysilane, 3-aminopropyltrimethoxysilane, and 3-aminopropyltriethoxysilane; a photoconductive imaging member wherein the organosilane (II) is 3-aminopropyltrimethoxysilane or 3-aminopropyltriethoxysilane; a photoconductive imaging member comprised in the following sequence of a supporting substrate, the crosslinked polymer hole blocking layer, of the formulas illustrated herein, an adhesive layer, a photogenerating layer and a charge transport layer; a photoconductive imaging member wherein the adhesive layer is comprised of a polyester with an $M_w$ of from about 50,000 to about 100,000, and preferably about 70,000, and an $M_n$ of preferably about 35,000; a photoconductive imaging member wherein the supporting substrate is comprised of a conductive metal substrate; a photoconductive imaging member wherein the conductive substrate is aluminum, aluminized polyethylene terephthalate or titanized MYLAR®; a photoconductive imaging member wherein said photogenerator layer is of a thickness of from about 0.05 to about 10 microns; a photoconductive imaging member wherein the transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the aryl amines are of the formula

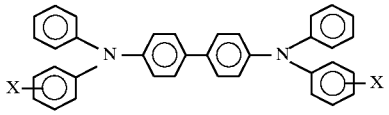

wherein X is selected from the group consisting of alkyl and halogen, and wherein the aryl amine is dispersed in a highly insulating and transparent resinous binder; a photoconductive imaging member wherein the arylamine alkyl contains from about 1 to about 10 carbon atoms; a photoconductive imaging member wherein the arylamine alkyl contains from 1 to about 5 carbon atoms; a photoconductive imaging member wherein the arylamine alkyl is methyl, wherein halogen is chlorine, and wherein the resinous binder is selected from the group consisting of polycarbonates and polystyrenes; a photoconductive imaging member wherein the aryl amine is N,N'-diphenyl-N,N-bis(3-methyl phenyl)-1,1'-biphenyl-4,4'-diamine; a photoconductive imaging member further including an adhesive layer of a polyester with an $M_w$ of preferably about 70,000, and an $M_n$ of from about 25,000 to about 50,000, and preferably about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member, developing the latent image, and transferring the developed electrostatic image to a suitable substrate; a photoconductive imaging member wherein there is accomplished a crosslinking of polymer (I) and organosilane (II) in the presence of a catalyst selected from the group consisting of carboxylic acids and amines; a photoconductive imaging member wherein acetic acid or an alkylamine is selected as the catalyst; an imaging member wherein a polymer is selected as a hole blocking layer, and is generated by crosslinking from the reaction of a mixture of electron transport polymer (I) and organosilane (II)

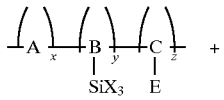

(I)

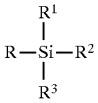

(II)

wherein E is an electron transport moiety; A, B, and C represents polymer segments; X is selected from the group consisting of chloride, bromide, iodide, cyano, alkoxy, and acyloxy; x, y, and z are mole fractions of the repeating monomer units wherein x+y+z is equal to about 1; R is alkyl or aryl; $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide; a crosslinked polymer of the formula

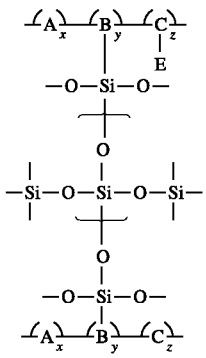

(VII)

wherein E is an electron transport moiety; A, B, and C represent segments of the polymer backbone; and x, y, and z represent mole fractions of the repeating monomer units wherein x+y+z is equal to about 1; a polymer prepared by crosslinking a mixture of electron transport polymer (I) and organosilane (II)

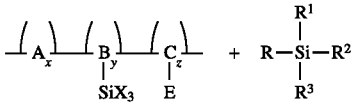

(I) (II)

wherein E is an electron transport moiety; A, B, and C represents the segments of the polymer backbone containing appropriate divalent linkages which connect or bond the silyl function ($SiX_3$) and the electron transport moiety (E) to the polymer backbone; X is selected from the group consisting of chloride, bromide, iodide, cyano, alkoxy, for example, of from about 1 to about 5 carbon atoms, acyloxy of, for example, from about 2 to about 6 carbon atoms, aryloxy of, for example, from about 6 to about 10 carbon atoms; x, y, and z are mole fractions of the repeating monomer units wherein x+y+z is equal to about 1; R is alkyl, substituted alkyl, aryl, or substituted aryl, with the substituent being halogen, alkoxy, aryloxy, amino, and the like; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide; and imaging members with a crosslinked siloxane polymer blocking layer; imaging members comprised of a supporting substrate, a crosslinked polymer blocking layer; thereover, a photogenerating layer of for example, hydroxygallium phthalocyanine, and a charge transport layer.

Of importance with respect to the present invention is the hole blocking layer which is comprised as schematically represented by formula (VII) a crosslinked polymer derived from crosslinking a silyl-functionalized electron transport polymer (I) with an organosilane as represented by (II).

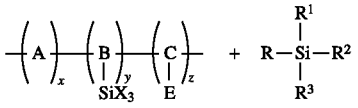

(I) (II)

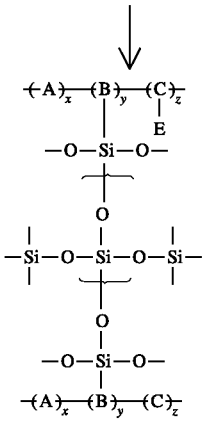

(VII)

wherein E is an electron transport moiety; A, B, and C represent the repeating structural units of the polymer backbone containing appropriate divalent linkages which connect the silyl function ($SiX_3$) and the electron transport moiety (E) to the polymer backbone; X is selected from the group consisting of chloride, bromide, iodide, cyano, alkoxy of from about 12 and preferably 5 to about 5 carbon atoms, acyloxy of from about 2 to about 6 carbon atoms, aryloxy of from about 6 to about 10 carbon atoms; x, y, and z are mole fractions of the repeating monomer units such that x+y+z is equal to about 1; R is alkyl, substituted alkyl, aryl, or substituted aryl group, with the substituent being preferably halogen atom, alkoxy, aryloxy, amino function, and the like; $R^1$, $R^2$, and $R^3$ are independently selected from the group consisting of alkyl, aryl, alkoxy, aryloxy, acyloxy, halide, cyano, amino, and the like, provided that for example two of $R^1$, $R^2$, and $R^3$ are alkoxy, aryloxy, acyloxy or halide function.

Illustrative examples of the divalent linkages include arylene (—Ar—), alkylenearyl (—R'—Ar—), alkyleneoxycarbonyl (—R'—O—CO—), aryleneoxycarbonyl (—Ar—O—CO—), alkylenearyloxycarbonyl (—R'—Ar—O—CO—), arylenealkoxycarbonyl (—Ar—R'—O—CO—), carbonyloxyalkyleneaminocarbonyl (—CO—O—R'—NR"—CO—), and the like, and wherein Ar preferably contains from about 6 to about 24 carbon atoms, R' preferably contains from about 1 to about 10 carbon atoms, and R" is hydrogen atom or alkyl group containing from about 1 to about 5 carbon atoms.

Illustrative examples of the organosilane (II) that are useful for the preparation blocking layers of the present invention are alkyl silanes, alkoxysilanes, and aminosilanes such as methyltrichlorosilane, dimethyldichlorosilane, methyltrimethoxysilane, methyltriethoxysilane, ethyltrichlorosilane, ethyltrimethoxysilane, dimethyidimethoxysilane, methyltriethoxysilane, ethyltriethoxysilane, propyltrimethoxysilane, 3-aminopropyltrimethoxysilane, 3-aminopropyl triethoxysilane, and the like.

Preferably, the silyl-functionalized electron transport polymer that is utilized in the preparation of the hole blocking layer of the present invention is represented by Formula (III)

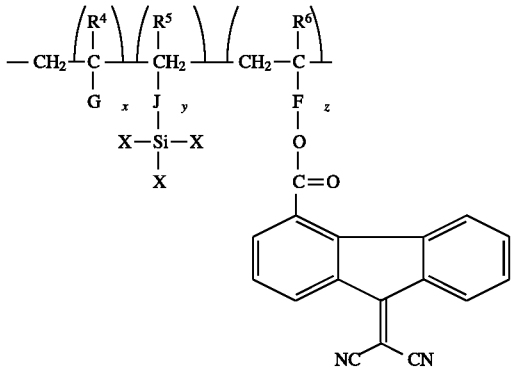

(III)

wherein $R^4$, $R^5$ and $R^6$ are independently selected from hydrogen atoms and alkyl groups of for example about 1 to about 3 carbon atoms; X is selected from the group consisting of chloride, bromide, iodide, cyano, alkoxy of about 1 to about 25 carbon atoms, and acyloxy of about 2 to about 10 carbon atoms; J is selected from the group consisting of alkyleneoxycarbonyl of about 2 to about 10 carbon atoms, arylene of 6 to about 15 carbon atoms, alkylenearyl of about 7 to about 15 carbon atoms, aryleneoxycarbonyl of about 7 to about 15 carbon atoms, and alkylenearyloxycarbonyl of about 8 to about 25 carbon atoms; F is arylene of about 6 to about 15 carbon atoms, arylenealkyl of about 7 to about 15 carbon atoms, carbonyloxyalkylene of about 2 to about 10 carbon atoms, and the like; G is chloride, cyano, aryl of about 6 to about 15 carbon atoms, alkoxycarbonyl of 2 to about 15 carbon atoms, aryloxycarbonyl of 7 to about 15 carbon atoms, and the like; x, y and z are the mole fractions of the repeating units of the polymer, and wherein x is a number that ranges from about 0 to about 0.95, and preferably from about 0.05 to about 0.75, y ranges from about 0.01 to about 0.50, and preferably from about 0.02 to about 0.15 and z ranges from about 0.01 to about 0.50, and preferably from about 0.05 to about 0.25 such that wherein the sum of x+y+z is equal to about 1.

Preferably in embodiments of the present invention, polymer (III) that are utilized in the preparation of the hole blocking layers of the present invention is selected from the group consisting of polymer (III-a) through (III-h)

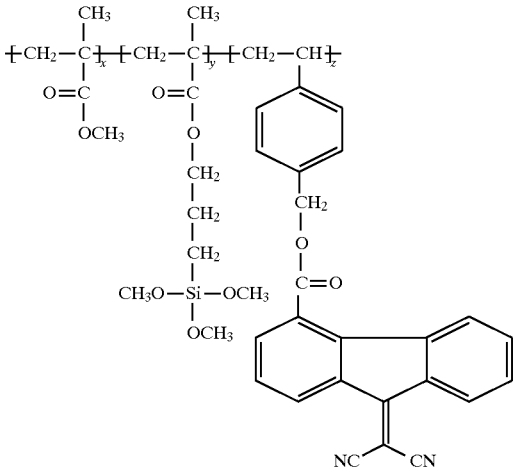

(III-a)

-continued

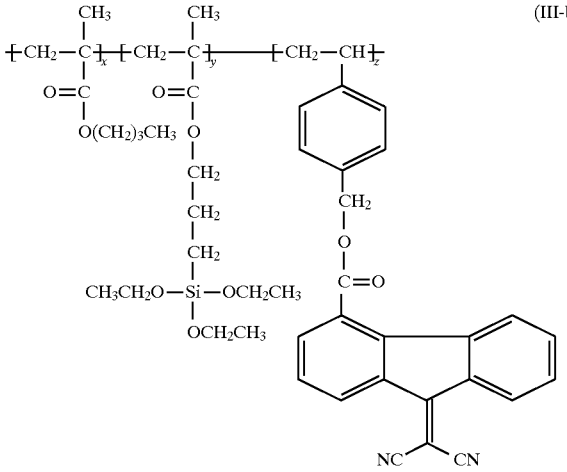

(III-b)

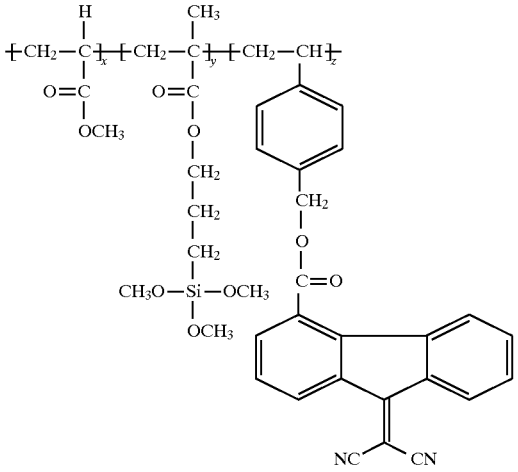

(III-c)

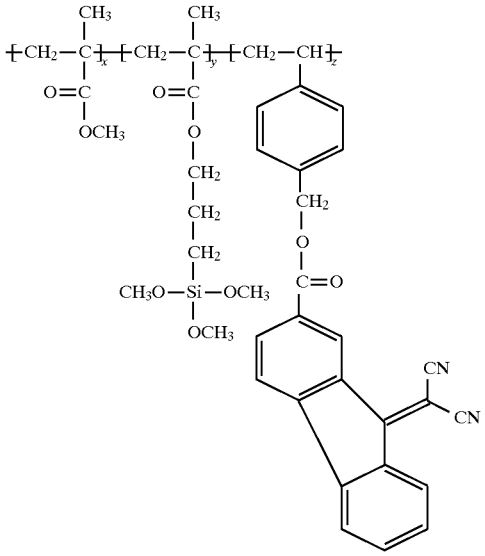

(III-d)

-continued (III-e)

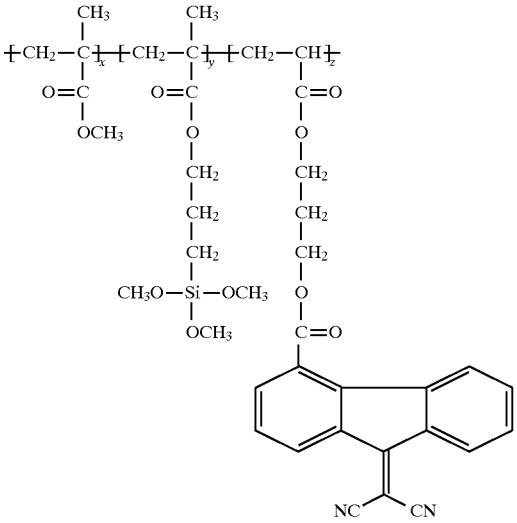

(III-f)

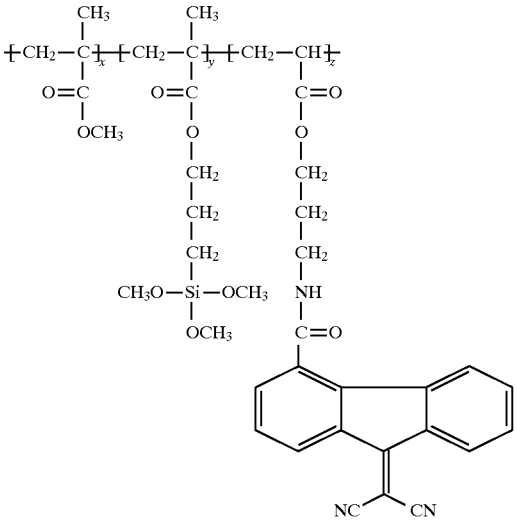

(III-g)

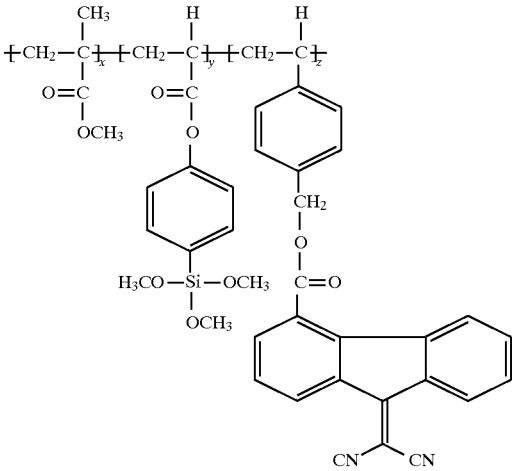

-continued (III-h)

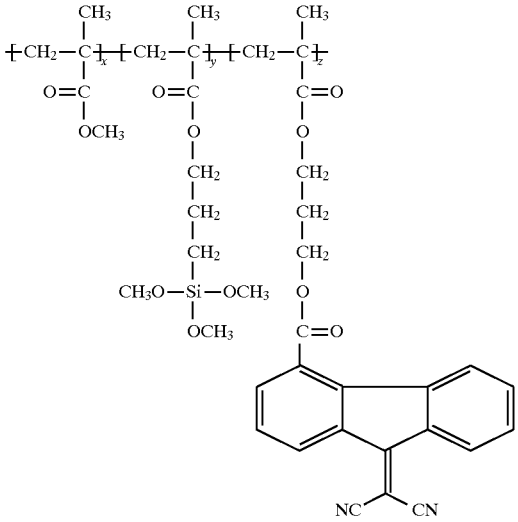

Polymer (III) of the present invention can be prepared by free radical polymerization according to Scheme 1. Specifically, this polymer can be prepared by polymerization of a mixture of vinyl monomers (IV), (V), and (VI) in the presence of a suitable radical initiator such as benzoyl peroxide, 2,2'-azobis(2-methylpropanenitrile), and the like. The polymerization is generally accomplished in an inert solvent such as toluene, benzene, tetrahydrofuran, chloroform, or the like, at a temperature of between about 40° C. to about 120° C. A specific preparative procedure for polymer (III) is as follows. A mixture of monomers (IV), (V), and (VI) in effective molar equivalent amounts and a solvent such as toluene are first charged to a reactor. The mixture is stirred at a temperature ranging from ambient to about 70° C. for about 5 to 30 minutes. Subsequently, an initiator such as benzoyl peroxide is added and the mixture is heated at about 50 to about 100° C. for a suitable period, for example from 5 to 24 hours to complete the polymerization. After the polymerization, the reaction mixture is diluted with a solvent such as toluene, and poured into hexane to precipitate the polymer product. The latter is collected by filtration and dried in vacuo to give polymer (III), which is characterized by gel permeation chromatography (GPC), and other relevant spectroscopic techniques such as IR and NMR spectroscopy.

Scheme 1

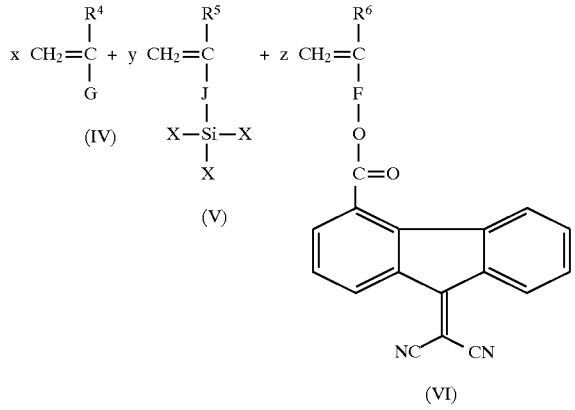

-continued

Scheme 1

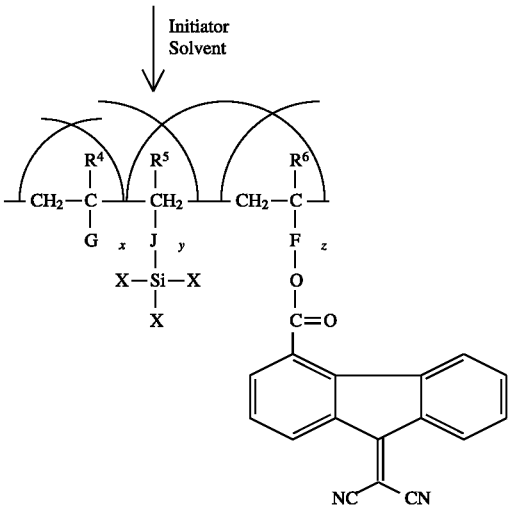

(III)

Illustrative examples of monomer (IV) selected for the preparation of polymer (III) include acrylic and methacrylic esters such as methyl acrylate, ethyl acrylate, propyl acrylate, butyl acrylate, methyl methacrylate, ethyl methacrylate, propyl methacrylate, butyl methacrylate, phenyl acrylate, phenyl methacrylate, and the like. Illustrative examples of monomer (V) include 3-acryloxypropyltrimethoxysilane, 3-methacyloxypropyltrimethoxysilane, 3-acryloxypropyltriethoxysilane, 3-methacyloxypropyltriethoxysilane, 3-acryloxyethyltrimethoxysilane, 3-methacyloxyethyltrimethoxysilane, 3-methacryloxypropyldimethylethoxysilane, allyltrimethoxysilane, allyltriethoxysilane, and the like, and examples of vinyl monomer (VI) include p-vinylbenzyl 9-dicyanomethylenefluorene-4-carboxylate (1); p-isopropenylbenzyl 9-dicyanomethylenefluorene-4-carboxylate (2); p-vinylbenzyl 9-dicyanomethylenefluorene-2-carboxylate (3); methacryloyloxyethyl 9-dicyanomethylenefluorene-4-carboxylate (4); acryloyloxyethyl 9-dicyanomethylenefluorene-4-carboxylate (5); methacryloyloxyethyl 9-dicyanomethylenefluorene-2-carboxylate (6); acryloyloxyethyl 9-dicyanomethylenefluorene-2-carboxylate (7); methacryloyloxypropyl 9-dicyanomethylenefluorene-4-carboxylate (8); and the like. The x, y and z represent molar equivalents of (IV), (V) and (VI), respectively, or mole fractions of the repeating units of polymer (III) such that x ranges from about 0 to about 0.50, y ranges from about 0.01 to about 0.50, and z ranges from about 0.01 to about 0.50, provided that x+y+z is equal to about 1.

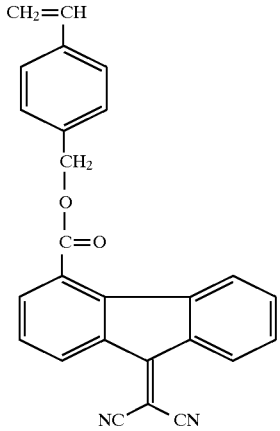

(1)

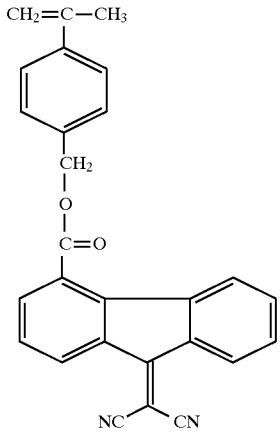

(2)

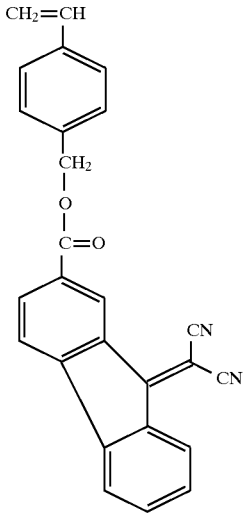

(3)

-continued (4)

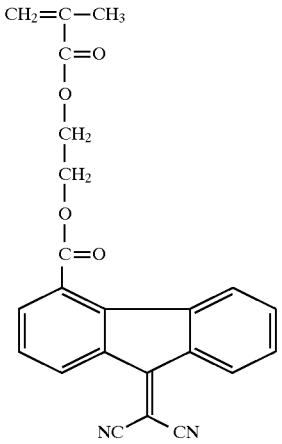

(5)

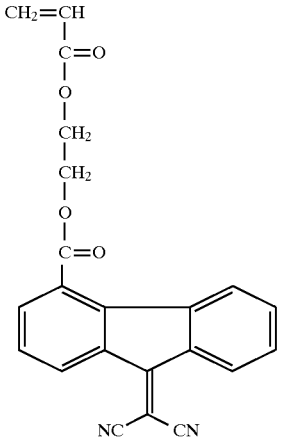

(6)

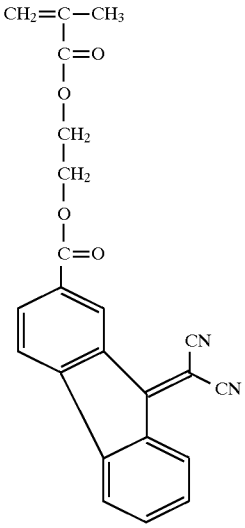

-continued (7)

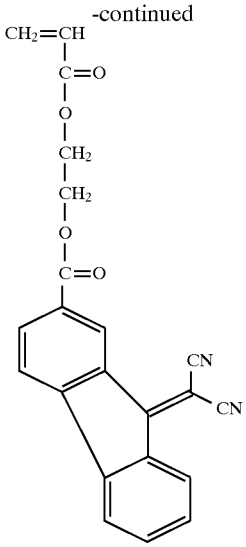

(8)

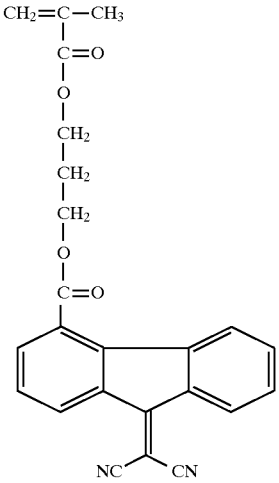

In embodiments of the present invention, the fabrication of the hole blocking layers of the present invention involve coating a solution of polymer (III) and organosilane (II) in a suitable solvent onto a supporting substrate. The coated layer is then thermally dried and cured at an elevated temperature. The curing or crosslinking can generally be accomplished at, for example, about 40° C. to about 200° C., and preferably from about 80° C. to about 150° C. for a suitable time period such as from about 15 minutes to about 2 hours. The crosslinking processes, as illustrated in Scheme 2, involving the hydrolysis of the silyl groups of organosilane (II) and polymer (III) to the hydroxysilyl functions, followed by condensation to form the siloxane (Si—O—Si) bonds. It is important that some water, for example from about 1 to about 15 weight percent, is present in the coating solution to effect the hydrolysis for the crosslinking reaction to occur. Trace amounts of water, such as for example about 0.01 percent by weight of solvent that are present in the coating solvents, may often be sufficient to induce the required hydrolysis reaction. Also, water may be added, particularly if the coating solvent is a water-mixable one such as tetrahydrofuran, methanol, ethanol, methyl ethyl ketone. Additionally, curing or crosslinking of the coated blocking layers may also be induced to occur by humidification via exposing to a moist atmosphere prior to or during thermal treatment to effect the crosslinking reactions.

Scheme 2

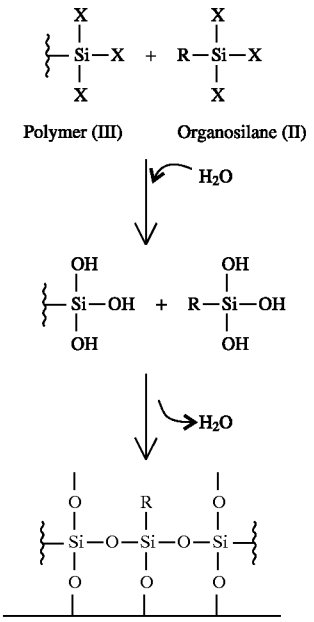

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the member. In one embodiment, the thickness of this layer is from about 75 microns to about 300 microns.

The photogenerating layer, which is preferably comprised of hydroxygallium phthalocyanine Type V, is in embodiments comprised of, for example, about 50 weight percent of the Type V and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis (benzimidazo)perylene, titanyl phthalocyanines, and the like, and more specifically vandayl phthalocyanines, Type V hydroxygallium phthalocyanines, and inorganic components such as selenium, especially trigonal selenium. The photogenerating pigment can be dispersed in a resin binder, similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 micron when, for example, the photogenerator compositions is present in an amount of from about 30 to about 75 percent by volume. The maximum thickness of the layer in an embodiment is dependent primarily upon factors, such as photosensitivity, electrical properties and mechanical considerations. The photogenerating layer binder resin, present in various suitable amounts, for example from about 1 to about 50, and more specifically from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns and preferably from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesives usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the hole transporting layers, which generally is of a thickness of from about 5 microns to about 75 microns, and preferably of a thickness of from about 10 microns to about 40 microns, include molecules of the following formula

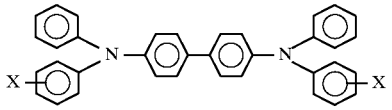

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Synthesis of Polymer (III-a with x=0.94, y=0.01, and z=0.05):

To a 1 liter round bottomed flask were added 60.0 grams of 9-dicyanonmethylenefluorene-4-carboxylic acid, 700 milliliters of N,N-dimethylformamide, 67.1 grams of 4-vinylbenzyl chloride, and 37.0 grams of sodium bicarbonate, and the resulting mixture was stirred at 40° C. for 48 hours. The mixture was poured into 1,500 milliliters of distilled water with vigorous stirring, and the resulting aqueous mixture was extracted with 1,000 milliliters of dichloromethane. The organic layer was separated and was further washed with 1,500 milliliters of distilled water and dried over anhydrous magnesium sulfate. Subsequently, the organic solvent was removed by means of a rotary evaporator and the residue was recrystallized from a mixture of dichloromethane and methanol (2:1 by volume) to give vinylbenzyl 9-dicyanomethylenefluorene-4-carboxylate after filtration and drying in vacuo for 48 hours.

$^1$H-NMR ($CDCl_3$): δ 5.30 (d, J=10.5 Hz, 1H), 5.43 (s, 2H), 5.79 (d, J=17.5 Hz, 1H), 6.73 (d, J=10.5 Hz, 2H), 7.31~7.48 (m, overlapping with a singlet at 7.45, 7H), 7.88 (d, J=7.9 Hz, 1H), 8.07 (d, 7.9 Hz, 1H), 8.45 (d, J=7.8 Hz, 1H), 8.59 (d, J=7.9 Hz, 1H). IR (KBr): 2224 (CN), 1735 (C═O) $cm^{-1}$.

To a 1 liter three-neck round-bottomed flask, under a nitrogen blanket, were added 7.90 gram of vinylbenzyl 9-dicyanomethylene fluorene-4-carboxylate as obtained above, 42.77 grams of methyl methacrylate, 1.12 grams of 3-(trimethoxysilyl) propyl methacrylate, and 400 milliliters of toluene. The resulting mixture was stirred at about 50° C. for 10 minutes, followed by the addition of 0.427 gram of benzoyl peroxide initiator. The mixture was subsequently stirred at 90° C. for 24 hours. The resulting polymer solution was diluted with 1,100 milliliters of toluene at room temperature, about 25° C. throughout, and was then poured into 6,000 milliliters of hexane with stirring to precipitate the polymer product. The solid product, polymer (III-a), was collected by filtration and dried at room temperature in vacuo for 24 hours to give 44.21 grams (85.4 percent) of polymer (III-a). The polymer displayed an $M_w$ of 59,463 and $M_n$ of 24,389 as measured by GPC and IR (film) absorption of 2,223 (CN) and 1,736 (C═O) $cm^{-1}$.

EXAMPLE II

Synthesis of Polymer (III-a with x=0.88, y=0.07, and z=0.05):

The polymer was prepared in accordance to the procedure of Example I except that 4.01 grams of vinylbenzyl 9-dicyanomethylene fluorene-4-carboxylate, 20.16 grams of methyl methacrylate, 4.00 grams of 3-(trimethoxysilyl) propyl methacrylate, and 80 milliliters of toluene were utilized. The yield was 25.0 grams (88.7 percent).

The polymer displayed an $M_w$ of 132,914 and $M_n$ of 41,367 as measured by GPC and IR (film) absorption of 2,220 (CN) and 1,736 (C═O) $cm^{-1}$.

EXAMPLE III

An illustrative photoresponsive imaging device incorporating the blocking layer of the present invention was fabricated as follows.

On a 75-micron thick titanized MYLAR® substrate was coated by draw bar technique with a hole blocking layer from a solution of 0.75 grams of polymer (III-a) of Example I and 0.75 gram of 3-aminopropyltrimethoxysilane in 5 millimeters of a 50:50 (by volume) mixture of toluene/tetrahydrofuran. After drying at 120° C. for 1 hour, a blocking layer (HBL) encompassed by Formula VII of a thickness of about 2 to 2.5 microns was obtained. Overcoated on the top of the blocking layer was a 0.05 micron thick adhesive layer prepared from a solution of 2 weight percent of a DuPont 49K polyester in dichloromethane. A 0.2 micron photogenerating layer was subsequently coated on top of the adhesive layer from a dispersion of hydroxy gallium phthalocyanine Type V (0.46 gram) and a polystyrene-b-polyvinylpyridine block copolymer (0.48 gram) in 20 grams of toluene, followed by drying at 100° C. for 10 minutes. Subsequently, a 25-micron charge transport layer (CTL) was coated on top of the photogenerating layer from a solution of N,N'-diphenyl-N,N-bis(3-methyl phenyl)-1,1'-biphenyl-4,4'-diamine (2.64 grams) and a polycarbonate (3.5 grams) in 40 grams of dichloromethane.

A control device was also prepared in a similar manner without a blocking layer.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

The following table summarizes the electrical performance of these devices, which shows the effective blockage of charge injection by the hole blocking layer (HBL) of the present invention. Specifically, while the dark development potential ($V_{ddp}$), the half discharge exposure energy ($E_{1/2}$), and the residual voltage are similar for the control device and the device of the present invention, the dark decay, which measures the dark conductivity related to hole injection into the photogenerator layer, of the device of the present invention is significantly lower than that of the control device.

| Device | CTL (μm) | Vddp (V) | $E_{1/2}$ ergs/cm$^2$ | Dark Decay (V @ 500 ms) | Vr (V) |
|---|---|---|---|---|---|
| Control Device Without HBL | 25.4 | 813 | 1.54 | 19.6 | 0–4 |
| Device with 2.0–2.5 μm Crosslinked Siloxane HBL | 24.1 | 798 | 1.58 | 9.9 | 0–6 |

EXAMPLE IV

Another photoresponsive imaging device with a hole blocking layer of the present invention was fabricated in accordance to the procedure of Example III except that the HBL thickness was increased to about 5 microns instead of 2.5 microns. The blocking layer was prepared from a solution of 1.0 grams of polymer (III-a) of Example I and 1.0 gram of 3-aminopropyl trimethoxysilane in 5 milliliters of toluene. The following table summarizes the electrical performance of this device:

| Device | CTL (μm) | Vddp (V) | $E_{1/2}$ ergs/cm$^2$ | Dark Decay (V @ 500 ms) | Vr (V) |
|---|---|---|---|---|---|
| Control Device Without HBL | 25.4 | 813 | 1.54 | 19.6 | 0–4 |
| Device with 4.8–5.3 μm Crosslinked Siloxane HBL | 25.4 | 806 | 1.49 | 14.3 | 4–12 |

EXAMPLE V

A photoresponsive imaging device with a hole blocking layer derived from polymer III-a of Example II was prepared in accordance to procedure of Example III. The HBL thickness was about 1.0 to 1.5 micron, and was prepared from a solution of 0.25 gram of polymer (III-a) of Example II and 0.25 gram of 3-aminopropyltrimethoxysilane in 5 milliliters of toluene. The following table summarizes the electrical performance of this device.

| Device | CTL (μm) | Vddp (V) | $E_{1/2}$ ergs/cm$^2$ | Dark Decay (V @ 500 ms) | Vr (V) |
|---|---|---|---|---|---|
| Control Device Without HBL | 25.4 | 813 | 1.54 | 19.6 | 0–4 |
| Device with 1.0–1.5 μm Crosslinked Siloxane HBL | 25.2 | 803 | 1.41 | 7.0 | 1–12 |

EXAMPLE VI

Another photoresponsive imaging device with a hole blocking layer derived from Polymer III-a of Example II was fabricated in accordance to the procedure of Example V except that the HBL thickness was 1.5 to 2.0 microns instead of 1.0 to 1.5 microns. The following table summarizes the electrical performance of this device:

| Device | CTL (μm) | Vddp (V) | $E_{1/2}$ ergs/cm$^2$ | Dark Decay (V @ 500 ms) | Vr (V) |
|---|---|---|---|---|---|
| Control Device Without HBL | 25.4 | 813 | 1.54 | 19.6 | 0–4 |
| Device with 1.5–2.0 μm Crosslinked Siloxane HBL | 24.6 | 802 | 1.45 | 13.6 | 0–3 |

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hole blocking layer thereover, a photogenerating layer and a charge transport layer, and wherein the hole blocking layer is comprised of a crosslinked polymer of the formula

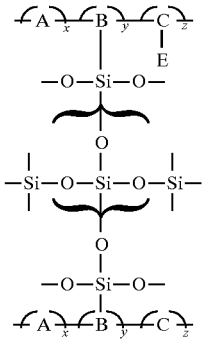

(VII)

wherein E is an electron transport moiety; A, B, and C represent the segments of the polymer backbone containing appropriate divalent linkages; and x, y, and z are mole fractions of the repeating monomer units wherein x+y+z is equal to about 1.

2. A photoconductive imaging member in accordance with claim 1 wherein x is from about 0 to about 0.95, y is from about 0.01 to about 0.50, and z is from about 0.01 to about 0.50.

3. A member in accordance with claim 1 wherein crosslinking is accomplished from the reaction of a mixture of electron transport polymer (I) and organosilane (II)

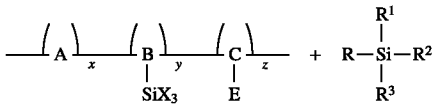

(I) (II)

wherein E is an electron transport moiety; A, B, and C represents polymer segments; X is selected from the group consisting of chloride, bromide, iodide, cyano, alkoxy, acyloxy; x, y, and z are mole fractions of the repeating monomer units wherein x+y+z is equal to about 1; R is alkyl or aryl; $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide.

4. A photoconductive imaging member in accordance with claim 3 wherein said two divalent linkages of (I) are independently selected from the group consisting of arylene (—Ar—), alkylenearyl (—R'—Ar—), alkyleneoxycarbonyl (—R'—O—CO—), aryleneoxycarbonyl (—Ar—O—CO—), alkylenearyloxycarbonyl (—R'—Ar—O—CO—), arylenealkoxycarbonyl (—Ar—R'—O—CO—), and carbonyloxyalkyleneaminocarbonyl (—CO—O—R'—NR"—CO—), and wherein Ar contains from about 6 to about 24 carbon atoms, R' contains from about 1 to about 10 carbon atoms, and R" is hydrogen or alkyl.

5. A photoconductive imaging member in accordance with claim 3 wherein organosilane (II) is selected from the group consisting of methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, and 3-aminopropyltriethoxysilane.

6. A photoconductive imaging member in accordance with claim 3 wherein the hole blocking layer is prepared from crosslinking said organosilane (II) and said electron transport polymer (III)

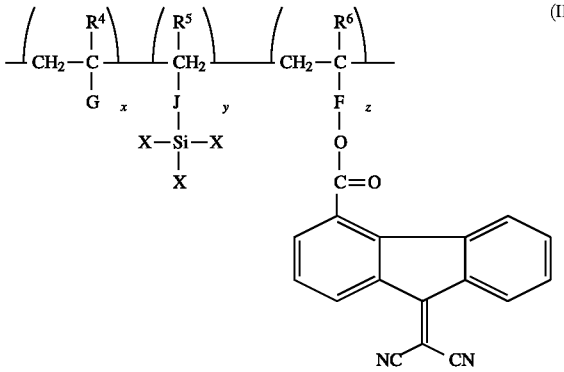

(III)

wherein $R^4$, $R^5$ and $R^6$ are hydrogen and alkyl groups; X is selected from the group consisting of chloride, bromide, iodide, cyano, alkoxy of about 1 to about 10 carbon atoms, and acyloxy of about 2 to about 10 carbon atoms; J is selected from the group consisting of alkyleneoxycarbonyl of about 2 to about 10 carbon atoms, arylene of about 6 to about 15 carbon atoms, alkylenearyl of about 7 to about 15 carbon atoms, aryleneoxycarbonyl of about 7 to about 15 carbon atoms, and alkylenearyloxycarbonyl of about 8 to about 25 carbon atoms; F is arylene of about 6 to about 15 carbon atoms, arylenealkyl of about 7 to about 15 carbon atoms, carbonyloxyalkylene of about 2 to about 10 carbon atoms, and the like; G is chloride, cyano, aryl of about 6 to about 15 carbon atoms, or alkoxycarbonyl of 2 to about 15 carbon atoms, or aryloxycarbonyl of 7 to about 15 carbon atoms; x, y and z are the mole fractions of the repeating units of the polymer, and wherein x ranges from about 0 to about 0.95, y ranges from about 0.01 to about 0.50, and z ranges from about 0.01 to about 0.50, and wherein the sum of x+y+z is equal to 1.

7. A photoconductive imaging member in accordance with claim 6 wherein G is alkoxycarbonyl of from about 2 to about 10 carbon atoms, X is alkoxy of from about 1 to about 5 carbon atoms and F is alkylenearyl of from about 7 to about 15 carbon atoms.

8. A photoconductive imaging member in accordance with claim 6 wherein G is methoxycarbonyl, X is methoxy or ethoxy, and F is methylenephenyl.

9. A photoconductive imaging member in accordance with claim 6 wherein said hole blocking layer is of a thickness of about 0.1 to about 5 microns.

10. A photoconductive imaging member in accordance with claim 1 wherein said hole blocking layer is of a thickness of about 1 to about 5 microns.

11. A photoconductive imaging member in accordance with claim 6 wherein polymer (III) is selected from the group consisting of polymers of the formulas (III-a) through (III-h).

12. A photoconductive imaging member in accordance with claim 6 wherein said organosilane (II) is selected from the group consisting of methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, and 3-aminopropyltriethoxysilane.

13. A photoconductive imaging member in accordance with claim 12 wherein said organosilane (II) is 3-aminopropyltrimethoxysilane or 3-aminopropyltriethoxysilane.

14. A photoconductive imaging member in accordance with claim 6 comprised in the following sequence of a supporting substrate, said hole blocking layer, an adhesive layer, a photogenerating layer and a charge transport layer.

15. A photoconductive imaging member in accordance with claim 14 wherein the adhesive layer is comprised of a polyester with an $M_w$ of about 70,000, and an $M_n$ of about 35,000.

16. A photoconductive imaging member in accordance with claim 1 wherein the supporting substrate is comprised of a conductive metal substrate.

17. A photoconductive imaging member in accordance with claim 16 wherein the conductive substrate is aluminum, aluminized polyethylene terephthalate or titanized MYLAR®.

18. A photoconductive imaging member in accordance with claim 1 wherein said photogenerator layer is of a thickness of from about 0.05 to about 10 microns.

19. A photoconductive imaging member in accordance with claim 1 wherein said transport layer is of a thickness of from about 10 to about 50 microns.

20. A photoconductive imaging member in accordance with claim 1 wherein the photogenerating layer is comprised of photogenerating pigments dispersed in a resinous binder in an amount of from about 5 percent by weight to about 95 percent by weight.

21. A photoconductive imaging member in accordance with claim 20 wherein the resinous binder is selected from the group consisting of polyesters, polyvinyl butyrals, polycarbonates, polystyrene-b-polyvinyl pyridine, and polyvinyl formals.

22. A photoconductive imaging member in accordance with claim 1 wherein said charge transport layers comprises aryl amine molecules.

23. A photoconductive imaging member in accordance with claim 22 wherein the aryl amines are of the formula

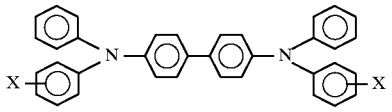

wherein X is selected from the group consisting of alkyl and halogen, and wherein the aryl amine is dispersed in a highly insulating and transparent resinous binder.

24. A photoconductive imaging member in accordance with claim 23 wherein alkyl contains from about 1 to about 10 carbon atoms.

25. A photoconductive imaging member in accordance with claim 24 wherein alkyl contains from 1 to about 5 carbon atoms.

26. A photoconductive imaging member in accordance with claim 23 wherein alkyl is methyl, wherein halogen is chlorine, and wherein the resinous binder is selected from the group consisting of polycarbonates and polystyrenes.

27. A photoconductive imaging member in accordance with claim 22 wherein the aryl amine is N,N'-diphenyl-N,N-bis(3-methyl phenyl)-1,1'-biphenyl-4,4'-diamine.

28. A photoconductive imaging member in accordance with claim 1 further including an adhesive layer of a polyester with an $M_w$ of about 70,000, and an $M_n$ of about 35,000.

29. A photoconductive imaging member in accordance with claim 1 wherein the photogenerating layer is comprised of metal phthalocyanines, or metal free phthalocyanines.

30. A photoconductive imaging member in accordance with claim 1 wherein the photogenerating layer is comprised of titanyl phthalocyanines, perylenes, or hydroxygallium phthalocyanines.

31. A photoconductive imaging member in accordance with claim 1 wherein the photogenerating layer is comprised of Type V hydroxygallium phthalocyanine.

32. A method of imaging which comprises generating an electrostatic latent image on the imaging member of claim 1, developing the latent image, and transferring the developed electrostatic image to a suitable substrate.

33. A photoconductive imaging member in accordance with claim 6 wherein there is accomplished a crosslinking of polymer (I) and organosilane (II) in the presence of a catalyst selected from the group consisting of carboxylic acids and amines.

34. A photoconductive imaging member in accordance with claim 33 wherein acetic acid or an alkylamine is selected as the catalyst.

* * * * *